US007388483B2

(12) United States Patent
Welles et al.

(10) Patent No.: US 7,388,483 B2
(45) Date of Patent: Jun. 17, 2008

(54) MONITORING STATUS OF RAILYARD EQUIPMENT USING WIRELESS SENSING DEVICES

(75) Inventors: Kenneth Brakeley Welles, Scotia, NY (US); Rahul Bhotika, Niskayuna, NY (US); David Michael Davenport, Niskayuna, NY (US); John Erik Hershey, Ballston Lake, NY (US); Robert James Mitchell, Waterford, NY (US); Emad Andarawis Andarawis, Ballston Lake, NY (US)

(73) Assignee: General Electric Company, Niskayuna, NY (US)

( * ) Notice: Subject to any disclaimer, the term of this patent is extended or adjusted under 35 U.S.C. 154(b) by 150 days.

(21) Appl. No.: 11/317,570

(22) Filed: Dec. 23, 2005

(65) Prior Publication Data

US 2007/0146152 A1 Jun. 28, 2007

(51) Int. Cl.

| | |
|---|---|
| ***G08B 1/08*** | (2006.01) |
| ***B60R 25/10*** | (2006.01) |
| ***B60Q 1/00*** | (2006.01) |
| ***B61L 5/20*** | (2006.01) |
| *G08B 3/00* | (2006.01) |

(52) U.S. Cl. ..... 340/539.22; 340/539.1; 340/539.11; 340/429; 340/545.3; 340/689; 340/547; 200/61.45 M; 200/61.52; 200/61.83; 701/19; 246/187 A; 246/292; 246/473 R

(58) Field of Classification Search ..... 340/539.22, 340/429, 440, 545.3

See application file for complete search history.

(56) References Cited

U.S. PATENT DOCUMENTS 3,544,960 A * 12/1970 Hayes ..... 246/473 R (Continued)

FOREIGN PATENT DOCUMENTS

EP 1270363 A1 1/2003

(Continued)

OTHER PUBLICATIONS

Denny et al., "Communications-Based Yard Control (CB:YCTM) System", Proceedings of the 2000 ASME/IEEE Joint Railroad Conference, Newark, NJ, Apr. 4-6, 2000, pp. 95-110, XP000975081.

PCT international Search Report dated Feb. 4, 2008.

*Primary Examiner*—Donnie L Crosland

(74) *Attorney, Agent, or Firm*—Shawn A. McClintic; William E. Powell, III

(57) ABSTRACT

A wireless position sensing device is provided for monitoring railyard equipment status. The device comprises a gravity sensing mechanism for sensing an angular displacement with respect to a substantially vertical line, and for generating a displacement signal upon sensing a change in angular displacement exceeding approximately 40 degrees. A processing mechanism, operatively coupled to the gravity sensing mechanism, receives the displacement signal. A radio frequency transmitter, responsive to the processing mechanism, transmits a data signal indicative of the angular displacement. The processing mechanism is programmed to activate the radio frequency transmitter upon receipt of the displacement signal. The gravity sensing mechanism is affixed, attached, or mechanically coupled to railyard equipment comprising at least one of a manually operated rail switch or a safety indicator.

25 Claims, 4 Drawing Sheets

U.S. PATENT DOCUMENTS 4,209,777 A * 6/1980 Morrison ..... 340/547
4,520,662 A 6/1985 Schmid ..... 79/129
4,838,173 A 6/1989 Schroeder et al. ..... 105/35
5,373,125 A * 12/1994 Ford et al. ..... 200/61.52
5,381,445 A 1/1995 Hershey et al. ..... 375/1
5,512,874 A * 4/1996 Poston ..... 340/426.26
5,586,669 A 12/1996 Seay et al. ..... 213/43
5,642,870 A 7/1997 Sargis
5,735,491 A 4/1998 Atkinson ..... 246/124
5,950,967 A 9/1999 Montgomery ..... 246/182
6,206,215 B1 3/2001 Maa ..... 213/75
6,471,162 B1 * 10/2002 Pace ..... 246/294
2002/0096604 A1 7/2002 Hager et al.
2003/0122039 A1 * 7/2003 Mollet et al. ..... 246/473 R
2003/0182030 A1 9/2003 Kraeling et al. ..... 701/19

FOREIGN PATENT DOCUMENTS

WO WO2007039706 A1 4/2007
WO WO 2007058773 A1 5/2007

* cited by examiner

MONITORING STATUS OF RAILYARD EQUIPMENT USING WIRELESS SENSING DEVICES

BACKGROUND

This invention relates generally to railyard equipment and, more particularly, to monitoring the status of railyard equipment from a remote location.

Railyards are the hubs of railroad transportation systems. Therefore, a broad spectrum of services are provided at railyards, including freight origination, interchange and termination, locomotive storage and maintenance, assembly and inspection of new trains, servicing of trains running through the facility, inspection and maintenance of railcars, and railcar storage. The various services in a railyard compete for resources such as personnel, equipment, and space in various facilities so that managing the entire railyard efficiently is a complex operation.

In order to improve the efficiency of railyard operations, it would be useful to monitor railyard equipment, such as blue flag indicators, rail switches, signaling equipment, and the like, from a remote location. A typical railyard may include hundreds of manually controlled switches that can be placed in either of two positions. Accordingly, the switch has a status that may be specified in terms of whether the switch is in a first position or a second position. Blue flag indicators are employed by railyard personnel to show that a track segment is locked out for safety purposes. In practice, blue flag indicators may take the form of signs, flags, or flashing lights. Blue flag indicators occupy one of two states: a "set" status and a "removed" status. When a blue flag indicator is in the "set" status, the track segment associated with the indicator is off limits to locomotives, and any railcars on the segment are not to be moved. On the other hand, when a blue flag indicator is in the "removed" status, the track segment is no longer off limits to locomotives, and any railcars on the segment may be moved.

An exemplary application of blue flag indicators is to protect workers during manual inspection of railcars. A block of railcars is moved onto a track segment for inspection. The track segment is formed by a section of two or more substantially parallel rails. Blue flag indicators are placed upright between the two parallel rails of the track segment at both ends of the track segment where the inspection is to take place, beyond each end of the block of railcars. The blue flag indicator provides an indication that the railcars are not to be moved and that no locomotive shall enter this track segment during the inspection process. One purpose of the blue flag indicator is to protect railcar inspectors. During railcar inspection, the blue flag indicators have a "set" status. After railcar inspection has been completed, the inspectors remove the blue flag indicators.

No presently existing technique provides inexpensive automated communication of blue flag indicator status or switch position status to a remote monitoring location. The status of a blue flag indicator can be communicated by voice over a radio link by the person setting or removing the blue flag indicator. Switch position status is not communicated to a centralized monitoring location unless that switch is a remotely controlled switch, whereas many presently existing railyard switches are not equipped for remote control.

It is possible to remotely sense the status of a switch thorough the use of wired sensors. A sensor is applied to a switch, with communication and power cables conveyed below ground in trenched conduit running from the sensor to the centralized monitoring location. However, digging a conduit trench in a rail yard is complicated by the constant movement of railcars, as well as by the hard-packed earth and track beds. Trenching of cables in a rail yard is an expensive and time consuming activity which adversely impacts railyard operations and the free movement of railcars. Although a limited number of specially configured railyard switches use wireless communication for remotely controlling the position of the switch, a relatively large number of existing conventional railyard switches do not have wireless sensing capability, and cannot be easily modified to include this capability. Rather, if wireless sensing capability is required, the conventional railyard switch must be removed and replaced with a new, specially configured wireless switch. This switch replacement process is tedious, labor intensive, and expensive.

In view of the foregoing considerations, what is needed is an improved technique for remotely monitoring the status of railyard equipment such as blue flag indicators and rail switches. Such monitoring should not require installation of underground cables throughout the railyard.

SUMMARY OF THE INVENTION

Pursuant to one set of embodiments, a wireless position sensing device is provided for monitoring railyard equipment status. The device comprises a gravity sensing mechanism for sensing an angular displacement with respect to a substantially vertical line, and for generating a displacement signal upon sensing a change in angular displacement exceeding approximately 40 degrees. A processing mechanism, operatively coupled to the gravity sensing mechanism, receives the displacement signal. A radio frequency transmitter, responsive to the processing mechanism, transmits a data signal indicative of the angular displacement. The processing mechanism is programmed to activate the radio frequency transmitter upon receipt of the displacement signal. The gravity sensing mechanism is affixed, attached, or mechanically coupled to railyard equipment comprising at least one of a manually operated rail switch or a safety indicator.

Pursuant to another set of embodiments, a wireless magnetic sensing device is provided for monitoring railyard equipment status. The device comprises a magnetic sensing mechanism for sensing an applied magnetic field, and for generating a detection signal upon sensing of the applied magnetic field. A processing mechanism, operatively coupled to the magnetic sensing mechanism, receives the detection signal. A radio frequency transmitter, responsive to the processing mechanism, transmits a data signal indicative of the sensing of the applied magnetic field. The processing mechanism is programmed to activate the radio frequency transmitter upon receipt of the detection signal. The magnetic sensing mechanism is affixed, attached, or mechanically coupled to railyard equipment comprising at least one of a rail tie, a safety indicator, or a safety indicator receptacle.

Pursuant to another set of embodiments, a wireless magnetic sensing system is provided for monitoring railyard equipment status. The system comprises a wireless magnetic sensing device including: (i) a magnetic sensing mechanism for sensing an applied magnetic field, and for generating a detection signal upon sensing of the applied magnetic field; (ii) a processing mechanism, operatively coupled to the magnetic sensing mechanism, for receiving the detection signal; and (iii) a radio frequency transmitter, responsive to the processing mechanism, for transmitting a data signal indicative of said sensing of the applied magnetic field;

wherein the processing mechanism is programmed to activate the radio frequency transmitter upon receipt of the detection signal. The system also comprises a safety indicator affixed, attached, or mechanically coupled to the wireless magnetic sensing device; and a safety indicator receptacle, for receiving the safety indicator, and configured to have at least one permanent magnet in proximity thereto; wherein, when the safety indicator is inserted into the safety indicator receptacle, a magnetic field created by the permanent magnet across the receptacle is detected by the magnetic sensing mechanism of the magnetic sensing device.

Pursuant to another set of embodiments, a wireless magnetic sensing system is provided for monitoring railyard equipment status. The system comprises a wireless magnetic sensing device including: (i) a magnetic sensing mechanism for sensing an applied magnetic field, and for generating a detection signal upon sensing of the applied magnetic field; (ii) a processing mechanism, operatively coupled to the magnetic sensing mechanism, for receiving the detection signal; and (iii) a radio frequency transmitter, responsive to the processing mechanism, for transmitting a data signal indicative of said sensing of the applied magnetic field; wherein the processing mechanism is programmed to activate the radio frequency transmitter upon receipt of the detection signal. The system also comprises a safety indicator having one or more permanent magnets affixed, attached, or mechanically coupled thereto; and a safety indicator receptacle in proximity to the wireless magnetic sensing device for receiving the safety indicator; wherein, when the safety indicator is inserted into the safety indicator receptacle, a magnetic field created by the one or more permanent magnets is detected by the magnetic sensing mechanism of the magnetic sensing device.

DETAILED DESCRIPTION OF EXEMPLARY EMBODIMENTS OF THE INVENTION

Figure 1:
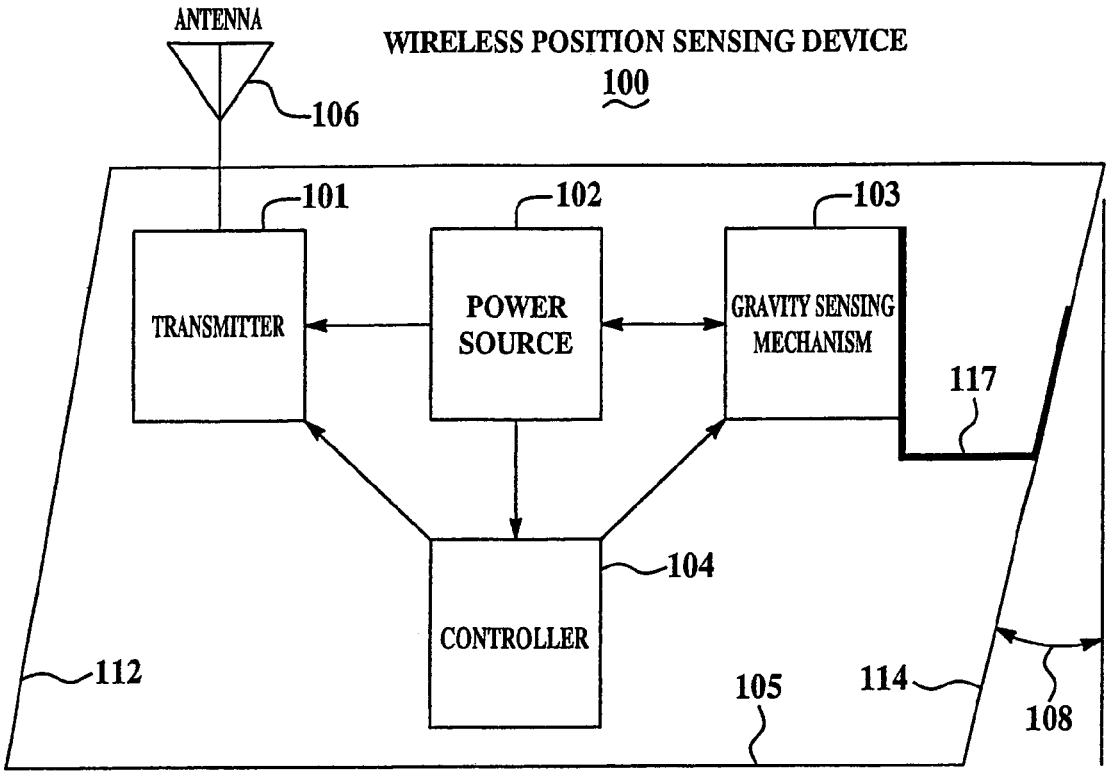
FIG. 1 is a block diagram of a wireless position sensing device for monitoring railyard equipment from a remote location in accordance with a set of embodiments of the present invention.

FIG. 1 is a block diagram of a wireless position sensing device 100 for monitoring status of railyard equipment from a remote location in accordance with a set of embodiments of the present invention. A power source 102 provides power to a transmitter 101, a controller 104, and a gravity sensing mechanism 103. Transmitter 101 is coupled to an antenna 106. A device casing 105 at least partially encases one or more of gravity sensing mechanism 103, controller 104, transmitter 101 and, optionally, power source 102. Power source 102 may be implemented using batteries, solar cells, a gravity-based power supply, a self-powered supply, other types of power sources, or any of various combinations thereof. For example, energy harvesting techniques may be used to provide supplemental power to trickle-charge a small battery, thus allowing for a reduction in required battery size and weight, or an extension of the battery life, or both.

Gravity sensing mechanism 103 is affixed to device casing 105 with an attachment mechanism 117 comprising at least one of a bracket, one or more fasteners or screws, adhesive, glue, one or more mechanical couplings or links, or by being affixed to another system component or portion thereof, such as all or a portion of transmitter 101, power source 102, or controller 104.

Controller 104 may be may implemented using a microprocessor-based device or microcontroller operating in response to a computer program capable of implementing the procedures described in greater detail hereinafter. For example, transmitter 101 and controller 104 may, but need not, be implemented together in the form of a single element using an integrated circuit device. Specific examples of such a device include the rFPIC 12F675 and the nRF24E1 manufactured and sold by Microchip Technology Incorporated and Nordic Semiconductor ASA, respectively. These integrated circuit devices contain a microcontroller with an integrated telemetry radio transmitter. In order to perform various prescribed functions and desired processing, as well as the computations therefor, controller 104 may include, but not be limited to, a processor(s), computer(s), memory, storage, register(s), timing, interrupt(s), communication interfaces, and input/output signal interfaces, as well as combinations comprising at least one of the foregoing. By way of example, a suitable microprocessor-based device may include a microprocessor connected to an electronic storage medium capable of storing executable programs, procedures or algorithms and calibration values or constants, as well as data buses for providing communications (e.g., input, output and within the microprocessor) in accordance with known technologies.

Gravity sensing mechanism 103 senses an angular position 108 of device casing 105 relative to a vertical line pointing straight up and down. For example, gravity sensing mechanism 103 detects whether or not device casing 105 is substantially upright (within 40 degrees, for example, of a substantially vertical line). Optionally, gravity sensing mechanism 103 may be equipped to distinguish device casing 105 resting with its right side 114 facing downward, as opposed to device casing resting with its left side 112 facing downward. Right-left orientation can be sensed with any of a number of existing technologies, such as a pendulum switch, a solid state accelerometer, an electrolytic level sensing device, or the like.

Gravity sensing mechanism 103 produces a signal when angular position 108 of device casing 105 relative to vertical is substantially changed, for example, by more than 40 degrees. This signal may be produced, for example, by a momentary contact closure. Upon gravity sensing mechanism 103 sensing a change in angular position of device casing 105, the signal produced by the gravity sensing mechanism is employed to alert controller 104. To allow sufficient time for gravity sensing mechanism 103 to stabilize after movement, controller 104 may be programmed to wait for a short duration, for example, five seconds. After expiration of the short duration, controller 104 determines angular position 108 of device casing 105 using an input signal received from gravity sensing mechanism 103.

Controller 104 uses transmitter 101 and antenna 106 to transmit a signal that includes sensing information. This sensing information includes a wireless position sensing device identifier that uniquely identifies wireless position sensing device 100, as well as a parameter indicative of the current angular position 108 of device casing 105. Controller 104 may be programmed to cause transmitter 101 to repeat this signal transmission a number of times to ensure that this sensing information is successfully communicated to a receiving device at a remote location. Optionally, wireless position sensing device 100 is equipped with a receiver, whereupon controller 104 may be programmed to cause transmitter 101 to repeat the transmission until the optional receiver receives an acknowledgement from a transmitter at the remote location. Moreover, if wireless communication is two-way, then controller 104 may respond to a query received from a remote location requesting the controller to specify the current angular position 108 of device casing 105. Wireless position sensing device 100 may be equipped to implement wireless communication over a one-way link or two-way link using any of a number of existing radio bands and communication protocols. Optionally, controller 104 may be programmed to "wake" at a repeated or periodic interval, such as every fifteen minutes, to activate transmitter 101 to transmit the device identifier and the current angular position 108 of device casing 105.

Figure 2:
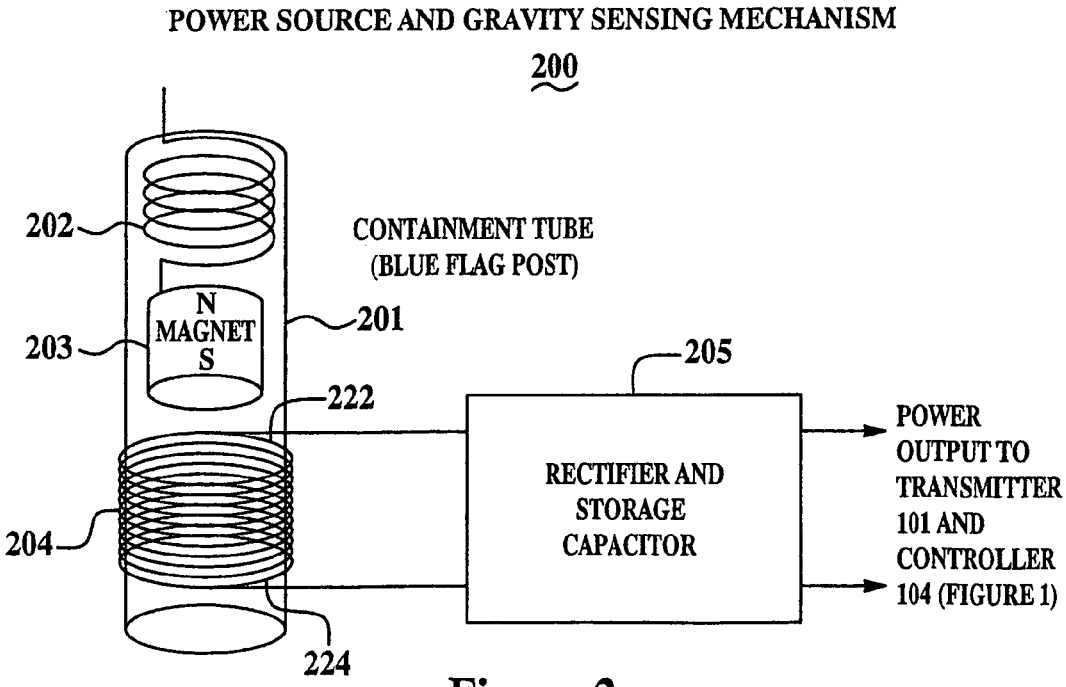
FIG. 2 is a block diagram of a power source and gravity sensing mechanism for use with the wireless position sensing device of FIG. 1.

FIG. 2 sets forth an exemplary power source and gravity sensing mechanism 200 that may be used to implement power source 102 and gravity sensing mechanism 103 of FIG. 1. A permanent magnet 203 (FIG. 2) is suspended by a spring 202 affixed proximate to an end of a containment tube 201. The force applied by spring 202 and the weight of magnet 203 are selected such that, if containment tube 201 is in a substantially vertical position with spring 202 positioned above a wire coil 204, then magnet 203 hangs below wire coil 204. Wire coil 204 has a first end 222 and a second end 224. If tube 201 is shifted from a substantially vertical position to a substantially horizontal position, then magnet 203 is pulled by spring 202 towards second end 224, through the central axis of wire coil 204, towards first end 222, and then beyond first end 222, with magnet 203 eventually stopping to rest outside of wire coil 204.

When tube 201 is moved from a substantially horizontal position to a substantially vertical position such that spring 202 is positioned above magnet 203, then spring 202 is stretched by the weight of magnet 203. Magnet 203 passes through tube 201 towards first end 222, through the central axis of wire coil 204, towards second end 224, and then beyond second end 224, eventually coming to rest below wire coil 204. Accordingly, whenever tube 201 is moved from a horizontal position to a vertical position, or from a vertical position to a horizontal position, magnet 203 passes through coil 204, thereby generating two electrical pulses of current as the magnet travels from first end 222, through the central axis of wire coil 204, and towards second end 224, or as the magnet travels from second end 224, through the central axis of wire coil 204, and towards first end 222. These electrical pulses of current are rectified and stored in a capacitor as an electrical charge. This electrical charge is then used to supply power to transmitter 101 (FIG. 1), such that the transmitter is enabled to transmit a signal indicative of the position of tube 201 (FIG. 2), and thereby indicative of the status of a railyard switch, blue flag, or other railyard equipment. A low-powered radio frequency transmitter having a power output in the milliwatt or microwatt range is suitable for this purpose. In situations where a battery is used to implement power source 102, these pulses of current may be used to generate an interrupt to "wake up" controller 104 from a low-power standby or sleep mode.

Figure 3:
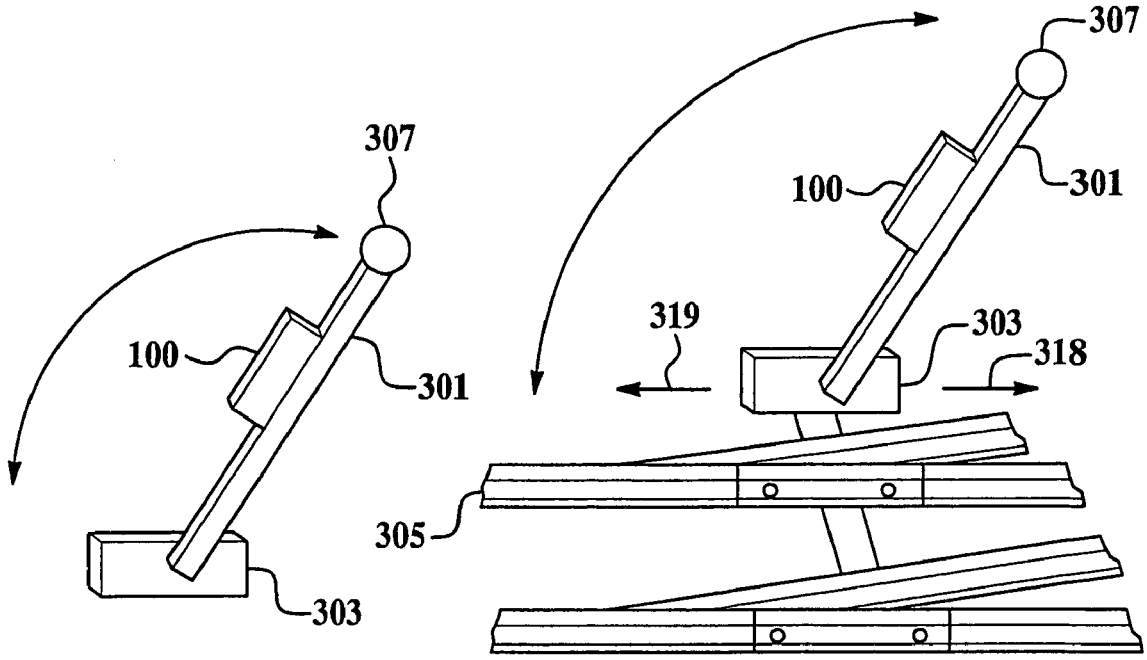
FIG. 3 a diagrammatic representation of the wireless position sensing device of FIG. 1 configured to monitor a manual rail switch.

FIG. 3 a diagrammatic representation of the wireless position sensing device of FIG. 1 configured to monitor a manually thrown rail switch, referred to hereinafter as a manual switch 303. Manual switch 303 includes a manual throw lever 301 which lays flat against the ground, either to the left or the right along a rail 305, except when manual throw lever 301 is to be used to change a position of manual switch 303 from a first position to a second position, or from a second position to a first position. When manual throw lever 301 lays flat against the ground, a free end 307 of manual throw lever 301 is oriented either towards a first direction 318 or a second direction 319 substantially opposite the first direction (i.e., substantially 180 degrees from the first direction) along rail 305, depending upon whether the direction of manual switch 303 is set to a first position or a second position. If manual switch 303 is set to the first position, free end 307 is oriented towards first direction 318, whereas if manual switch 303 is set to the second position, free end 307 is oriented towards second direction 319.

Assume that manual throw lever 303 is initially in a substantially horizontal position with free end 307 oriented towards first direction 318. Accordingly, manual switch 303 is in the first position. To change the direction of manual switch 303 from the first position to the second position, lever 303 is raised from its substantially horizontal position proximate to one side of rail 305, swung to a substantially vertical position along an arc, and placed back along rail 305 with manual throw lever 301 now in a substantially horizontal position, but with free end 307 now oriented towards second direction 319. Manual switch 303 is now in the second position.

In order to move manual switch 303 from the second position to the first position, lever 303 is raised from its substantially horizontal position proximate to one side of rail 305, swung to a substantially vertical position along an arc, and placed back along rail 305 with manual throw lever 301 now in a substantially horizontal position, but with free end 307 now oriented towards first direction 319.

Pursuant to one set of embodiments, wireless position sensing device 100 (FIGS. 1 and 3) is attached to manual throw lever 301 (FIG. 3). Gravity sensing mechanism 103 (FIG. 1) in wireless position sensing device 100 is capable of distinguishing whether free end 307 (FIG. 3) of manual throw lever 301 is oriented substantially towards first direction 318, as opposed to being oriented substantially towards second direction 319. Any time the direction of manual switch 303 is changed, gravity sensing mechanism 103 (FIG. 1) activates controller 104 and transmitter 101 to transmit a signal that includes data identifying manual switch 303 (FIG. 3) and data indicative of switch direction. The direction of the switch, also referred to as the status of the switch, specifies whether free end 307 of manual throw lever 301 is oriented towards first direction 318 as opposed to second direction 319. Additionally or in lieu of signal transmission taking place whenever the direction of manual switch 303 is changed, the status of manual switch 303 may also be communicated by wireless remote sensing device 100 at regular intervals, or when queried, as allowed by standard communication protocols.

Figure 4:
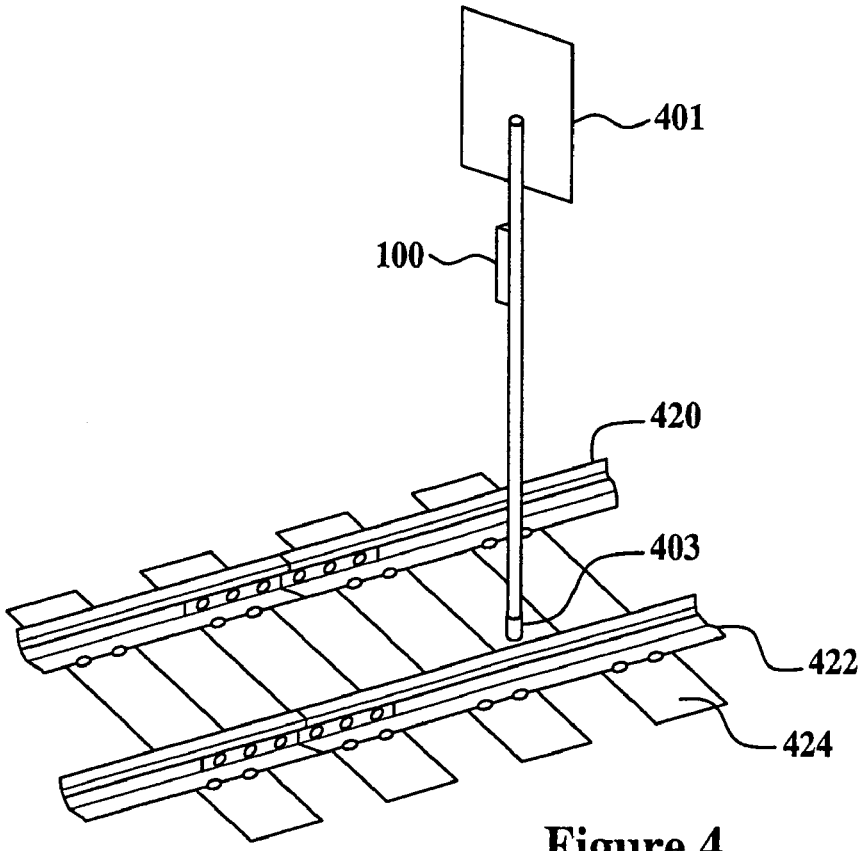
FIG. 4 is a diagrammatic representation of the wireless position sensing device of FIG. 1 configured to monitor a blue flag railroad safety indicator.

FIG. 4 is a diagrammatic representation of the wireless position sensing device 100 of FIG. 1 configured to monitor a blue flag safety indicator 401. To place safety indicator 401 in a "set" status, thereby providing a safety indication, the indicator is placed upright in a blue flag safety indicator receptacle 403 between a pair of parallel rails 420, 422 proximate to a segment of track which is to be protected. Accordingly, safety indicator 401 is in a substantially vertical position when in the "set" status.

When safety indicator 401 is to be placed in a status of "removed", thereby indicating that the safety indication is no longer required, the indicator is placed horizontally between or along one of parallel rails 420, 422 so that the indicator does not become misplaced or interfere with movement of cars or locomotives over the rails. Alternately, safety indicator 401 is fixed to a rail tie 424 using a hinged or pivoted connector. Safety indicator 401 is then manually raised from or lowered to a horizontal position via this hinged or pivoted connector.

Pursuant to a preferred embodiment disclosed herein, wireless position sensing device 100 (FIGS. 1 and 4) is attached to safety indicator 401 (FIG. 4). Gravity sensing mechanism 103 (FIG. 1) in wireless remote sensing device 100 is used to identify whether safety indicator 401 (FIG. 4) is in a vertical position (indicating a set status) as opposed to a horizontal position (indicating a removed status). Any time safety indicator 401 is raised (set) or lowered (removed), position sensing device 103 (FIG. 1) activates controller 104 and transmitter 101 to transmit a signal that includes data identifying blue flag railroad safety indicator 401 (FIG. 4) and data identifying the status of the safety indicator (set or removed). Additionally or in lieu of signal transmission taking place whenever the position of safety indicator 401 is changed from horizontal to vertical or vice versa, the status of the safety indicator may also be communicated by wireless position sensing device 100 (FIGS. 1 and 4) at regular intervals, or when queried, as allowed by standard communication protocols.

Transmitter 101 associated with wireless position sensing device 100 (FIGS. 1 and 4) and blue flag railroad safety indicator 401 (FIG. 4) may optionally be designed to transmit a wideband radio frequency signal that includes data identifying safety indicator 401 and the status of the indicator in the form of a phase-modulated, m-sequence signal. Further details regarding phase-modulated, m-sequence signals are disclosed in U.S. Pat. No. 5,381,445 entitled "Munitions Cartridge Transmitter", the disclosure of which is incorporated herein in its entirety. If a phase-modulated, m-sequence transmitter is used in wireless remote sensing device 100, then radio receivers (illustratively located on lighting poles within a railyard), may be utilized to detect and measure a defined epoch of the wideband signal received from one or more wireless remote sensing devices 100. A plurality of these epoch determinations are combined to yield an estimate of the location of blue flag railroad safety indicator 401 using a time difference of arrival (TDOA) technique.

Pursuant to a further embodiment, blue flag safety indicator receptacle 403 is equipped with an identifier stored in electronic memory. When safety indicator 401 is placed in receptacle 403, this electronic memory is queried, and the identification is communicated along with the status of the blue flag railroad safety indicator. Optionally, an electronically stored safety indicator identifier setting forth the identity of the safety indicator becomes associated with the electronically stored identifier of receptacle 403 at wireless position sensing device 100 upon placement of safety indicator 401 in receptacle 403. This feature enables wireless position sensing device 100 to communicate both the status of safety indicator 401, and the identification of a receptacle 403 in which safety indicator 401 is located. Since receptacles 403 are located at predetermined locations, the location of a locked-out track is easily identified. Alternatively or in addition to the foregoing techniques, the identification of receptacle 403 may be implemented using a wireless magnetic sensing device, as is described in greater detail hereinafter with reference to FIG. 5.

Figure 5:
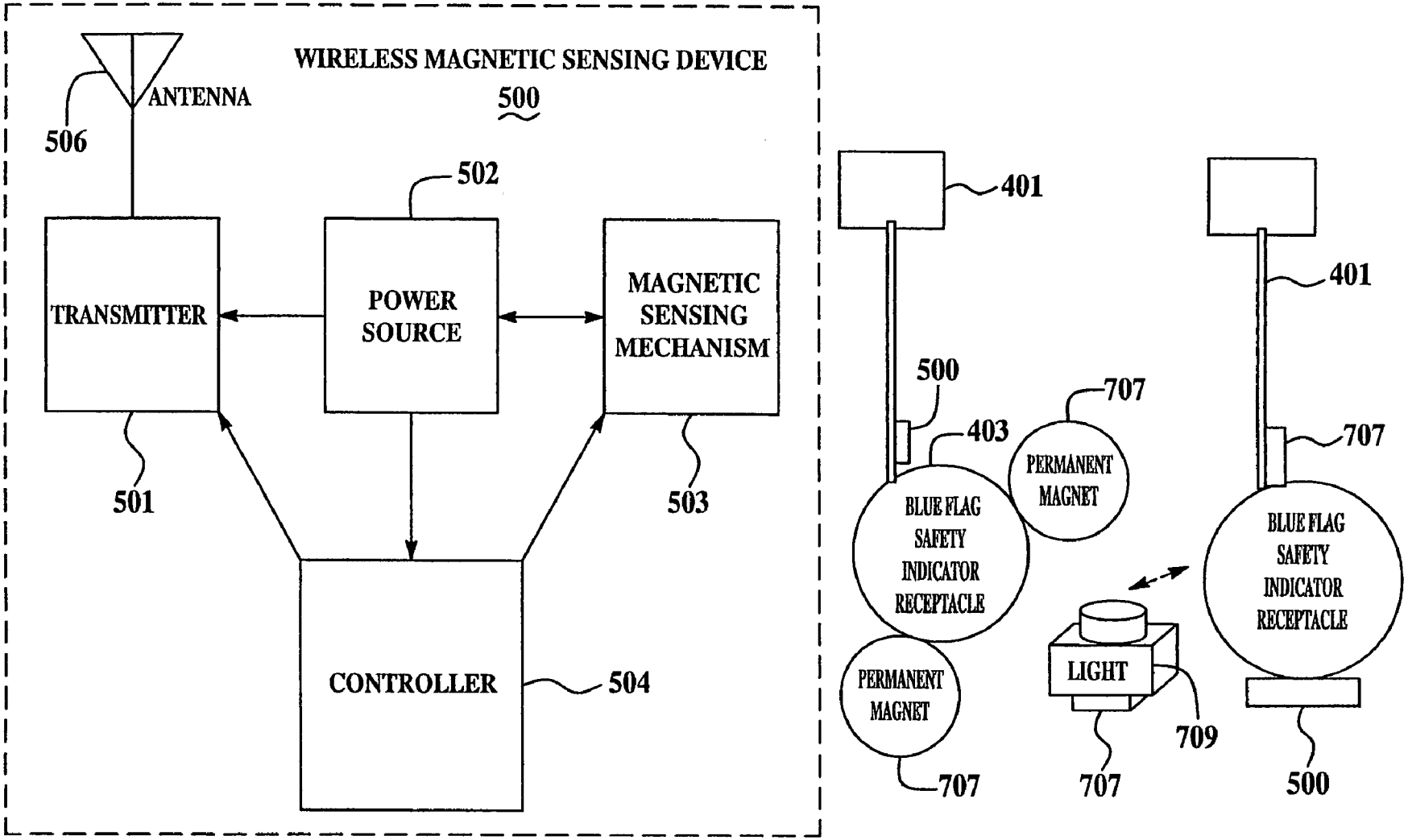
FIG. 5 is a block diagram of a wireless magnetic sensing device for monitoring railyard equipment from a remote location in accordance with a set of embodiments of the present invention.

FIG. 5 is a block diagram of a wireless magnetic sensing device 500 for monitoring railyard equipment from a remote location in accordance with a set of embodiments of the present invention. A power source 502 provides power to a transmitter 501, a controller 504, and a magnetic sensing mechanism 503. Transmitter 501 is coupled to an antenna 506. Power source 152 may be implemented using batteries, solar cells, a gravity-based power supply, a self-powered supply, other types of power sources, or any of various combinations thereof. For example, energy harvesting techniques may be used to provide supplemental power to trickle-charge a small battery, thus allowing for a reduction in required battery size and weight, or an extension of the battery life, or both.

Controller 504 may be may implemented using a microprocessor-based device or microcontroller operating in response to a computer program capable of implementing the procedures described in greater detail hereinafter. For example, transmitter 501 and controller 504 may, but need not, be implemented together in the form of a single element using an integrated circuit device. Specific examples of such a device include the rFPIC 12F675 and the nRF24E1 manufactured and sold by Microchip Technology Incorporated and Nordic Semiconductor ASA, respectively. These integrated circuit devices contain a microcontroller with an integrated telemetry radio transmitter. In order to perform various prescribed functions and desired processing, as well as the computations therefor, controller 504 may include, but not be limited to, a processor(s), computer(s), memory, storage, register(s), timing, interrupt(s), communication interfaces, and input/output signal interfaces, as well as combinations comprising at least one of the foregoing. By way of example, a suitable microprocessor-based device may include a microprocessor connected to an electronic storage medium capable of storing executable programs, procedures or algorithms and calibration values or constants, as well as data buses for providing communications (e.g., input, output and within the microprocessor) in accordance with known technologies.

Magnetic sensing mechanism 503 is implemented using any device or combination of devices that responds to an applied magnetic field. Illustratively, magnetic sensing mechanism 503 utilizes a plurality of magnetic reed switches, hall effect devices, or other magnetic field sensors arranged in a fixed, predetermined pattern or array.

Pursuant to one embodiment, wireless magnetic sensing device 500 may be mounted to blue flag safety indicator 401, whereupon blue flag safety indicator receptacle 403 is configured to have at least one permanent magnet 707 in proximity thereto. When safety indicator 401 is inserted into receptacle 403, a magnetic field created by permanent magnet 707 across receptacle 403 is detected by magnetic sensing mechanism 503 of magnetic sensing device 500. Optionally, a plurality of permanent magnets are placed in proximity to receptacle 403 in a predetermined array or arrangement.

Pursuant to another embodiment, wireless magnetic sensing device 500 is associated with receptacle 403, such that magnetic sensing mechanism 503 monitors any magnetic field in receptacle 403. Blue flag safety indicator 401 is configured with at least one permanent magnet attached thereto. Upon insertion of safety indicator into receptacle 403, a magnetic field created by permanent magnet 707 around safety indicator 401 is detected by magnetic sensing mechanism 503 of magnetic sensing device 500. Illustratively, magnetic sensing mechanism 503 includes a reed switch. The magnetic field from permanent magnet 707 closes the reed switch of magnetic sensing mechanism 503, waking controller 504 and initiating a report of blue flag status change transmitted by transmitter 501.

When blue flag safety indicator 401 (and the permanent magnet 707 associated therewith) are removed from receptacle 403, the reed switch opens. Controller 504 is programmed to initiate a transmission by transmitter 501 upon magnetic sensing mechanism 503 detecting any change of state in the reed switch. Optionally, a plurality of permanent magnets are attached to safety indicator 401 in a predetermined array or arrangement. Optionally, a light 709 may be configured with at least one permanent magnet 707 attached thereto for insertion into receptacle 403 or another type of receptacle equipped with wireless magnetic sensing device 500.

Pursuant to a further embodiment, wireless magnetic sensing device 500 is affixed to blue flag safety indicator 401. Blue flag safety indicator receptacle 403 (FIG. 5) is provided with one or more permanent magnets 707 in proximity thereto. An identity is created for receptacle 403 by providing the receptacle with a number of permanent magnets in proximity thereto having a unique configuration relative to configurations used by other receptacles 403. Accordingly, when a blue flag railroad safety indicator 401 (FIG. 5) equipped with wireless magnetic sensing device 500 is inserted into a receptacle 403 having a plurality of permanent magnets 707 in a predetermined physical arrangement proximate thereto, a pattern of switch closures corresponding to the unique identification of the receptacle is generated in magnetic sensing mechanism 503. Using controller 504 and transmitter 501, a data signal indicative of this switch closure pattern is transmitted along with data indicative of the status of safety indicator 401.

The identification of receptacle 403 may also be used as a means of determining the status of blue flag railroad safety indicator 401. For example, for a safety indicator 401 equipped with a wireless magnetic sensing device 500 that utilizes a plurality of reed switches to implement magnetic sensing mechanism 503, when indicator 401 is in a status of "removed" (not active), none of the reed switches will be closed. When safety indicator 401 is inserted into receptacle 403, a switch-closing pattern is generated in wireless magnetic sensing device 500 indicating that safety indicator 401 is active (set), as well as indicating the identification of the receptacle 403 in which the safety indicator 401 is inserted. Optionally, this switch closing pattern is used to generate a wake up signal that may be used to wake controller 504.

Controller 504 uses transmitter 501 and antenna 506 to transmit a signal that includes sensing information. This sensing information includes a wireless magnetic sensing device identifier that uniquely identifies wireless magnetic sensing device 500, as well as a parameter indicative of the current switch closing pattern of magnetic sensing mechanism 503. Controller 504 may be programmed to cause transmitter 501 to repeat this signal transmission a number of times to ensure that this sensing information is successfully communicated to a receiving device at a remote location.

Optionally, wireless magnetic sensing device 500 is equipped with a receiver, whereupon controller 504 may be programmed to cause transmitter 501 to repeat the transmission until the optional receiver receives an acknowledgement from a transmitter at the remote location. Moreover, if wireless communication is two-way, then controller 504 may respond to a query received from a remote location requesting the controller to specify the current switch closing pattern of magnetic sensing mechanism 503. Wireless magnetic sensing device 500 may be equipped to implement wireless communication over a one-way link or two-way link using any of a number of existing radio bands and communication protocols. Optionally, controller 504 may be programmed to "wake" at a repeated or periodic interval, such as every fifteen minutes, to activate transmitter 501 to transmit the device identifier and the current switch closure pattern of magnetic sensing mechanism 503.

Figure 6:
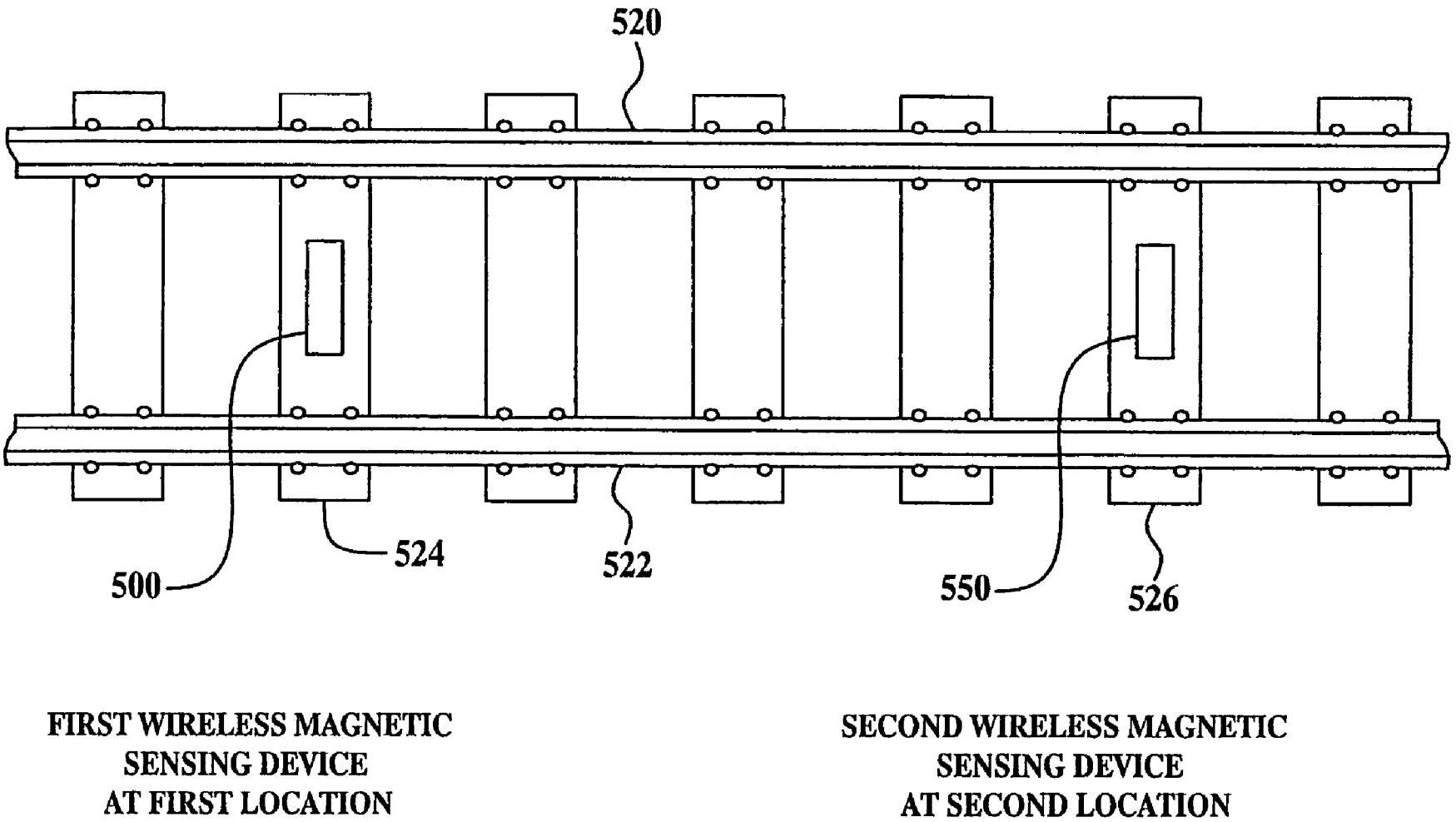
FIG. 6 is a diagrammatic representation of the wireless magnetic sensing device of FIG. 5 configured to monitor a blue flag safety indicator.

FIG. 6 is a diagrammatic representation of the wireless magnetic sensing device of FIG. 5 configured to monitor a blue flag railroad safety indicator. A plurality of wireless magnetic sensing devices are mounted at predetermined locations between a set of parallel rails 520, 522 forming a railroad track. In the example of FIG. 6, a first wireless magnetic sensing device 500 is positioned at a first location and mounted on a first rail tie 524. A second wireless magnetic sensing device 550 is positioned at a second location and mounted on a second railroad tie 526. First and second wireless magnetic sensing devices 500, 550 are each configured to provide a mounting receptacle for a blue flag safety indicator 401 (FIG. 5). At least a portion of blue flag safety indicator 401 is fabricated using metal. First and second wireless magnetic sensing devices 500, 550 (FIG. 6) each have unique identification numbers assigned to them and stored in an electronic memory associated with controller 504. Upon installation of first and second sensing devices 500, 550 at predetermined locations, this unique identification number is matched to the installation location.

When a blue flag safety indicator 401 (FIG. 5) is placed within the mounting receptacle of a respective sensing device 500, 550 (FIG. 6), the metal in indicator 401 interrupts a static magnetic field which is generated by a permanent magnet within the sensing device. In the absence of a blue flag safety indicator in the mounting receptacle, this static magnetic field maintains a reed switch in sensing device 500, 550 (FIG. 6), in a closed state. When the magnetic field is disturbed by blue flag safety indicator 401 (FIG. 5), the reed switch opens. This switch change provides a "wake" trigger to controller 504 (FIG. 5) for activating transmitter 501 to report a change in blue flag status.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A wireless position sensing device for monitoring railyard equipment status, the device comprising:

a gravity sensing mechanism for sensing an angular displacement with respect to a substantially vertical line, and for generating a displacement signal upon sensing a change in angular displacement exceeding approximately 40 degrees, wherein the gravity sensing mechanism comprises a containment tube having a first end and a second end, a permanent magnet having a mass and being suspended by a spring affixed proximate to the first end, and a wire coil wound about a portion of the containment tube, the mass of the permanent magnet being selected such that, if the containment tube is in a substantially vertical position with the first end substantially above the second end, then the magnet is suspended below the wire coil;

a processing mechanism, operatively coupled to the gravity sensing mechanism, for receiving the displacement signal; and a radio frequency transmitter, responsive to the processing mechanism, for transmitting a data signal indicative of said angular displacement;

wherein the processing mechanism is programmed to activate the radio frequency transmitter upon receipt of the displacement signal; and wherein the gravity sensing mechanism is affixed, attached, or mechanically coupled to railyard equipment comprising at least one of a manually operated rail switch or a safety indicator.

2. The wireless position sensing device of claim 1 further comprising a computer-readable memory associated with the processing mechanism, wherein the memory is capable of storing a position sensing device identifier that uniquely identifies the wireless position sensing device, and wherein the processing mechanism is programmed to activate the radio frequency transmitter to transmit the position sensing device identifier with the data signal.

3. The wireless position sensing device of claim 2 wherein the processing mechanism is programmed to repeatedly, periodically, or continuously activate the radio frequency transmitter to transmit the position sensing device identifier and the data signal.

4. The wireless position sensing device of claim 2 further comprising a receiver capable of receiving a radio frequency transmission from a remotely situated transmitter, wherein the processing mechanism is programmed to cause the radio frequency transmitter of the position sensing device to repeat transmission of the position sensing device identifier and the data signal until the receiver receives a signal from the remotely situated transmitter.

5. The wireless position sensing device of claim 2 for use with a plurality of receivers capable of receiving a transmission from the radio frequency transmitter, wherein the radio frequency transmitter is capable of transmitting a wideband, phase-modulated, m-sequence radio frequency signal that includes the position sensing device identifier and the data signal.

6. The wireless position sensing device of claim 5 wherein the plurality of receivers are each capable of determining a defined epoch of a received wideband, phase-modulated, m-sequence radio frequency signal received from the radio frequency transmitter.

7. The wireless position sensing device of claim 6 wherein a plurality of defined epoch determinations are combined to yield a location estimate for the wireless position sensing device using a time difference of arrival (TDOA) technique.

8. The wireless position sensing device of claim 2 further comprising a receiver capable of receiving a radio frequency transmission from a remotely situated transmitter, wherein the processing mechanism is programmed to cause the radio frequency transmitter of the position sensing device to transmit the position sensing device identifier and the data signal upon the receiver receiving a signal from the remotely situated transmitter.

9. The wireless position sensing device of claim 1 wherein the magnet generates a current in the coil in response to a change in displacement of the containment tube of at least approximately 40 degrees with reference to a vertical line.

10. The wireless position sensing device of claim 9 further comprising an electrical power extraction circuit operatively coupled to the wire coil for at least partially powering the transmitter and processing mechanism.

11. The wireless position sensing device of claim 10 wherein the electrical power extraction circuit comprises a rectifier circuit and a capacitor operatively coupled to the wire coil.

12. The wireless position sensing device of claim 11 wherein, when a change in displacement of the containment tube of at least approximately 40 degrees occurs, an electrical current is generated in the wire coil which, when rectified by the rectifier circuit, creates an electrical charge in the capacitor.

13. A wireless magnetic sensing device for monitoring railyard equipment status, the device comprising:

a magnetic sensing mechanism for sensing an applied magnetic field, and for generating a detection signal upon sensing of the applied magnetic field;

a processing mechanism, operatively coupled to the magnetic sensing mechanism, for receiving the detection signal; and a radio frequency transmitter, responsive to the processing mechanism, for transmitting a data signal indicative of said sensing of the applied magnetic field;

wherein the processing mechanism is programmed to activate the radio frequency transmitter upon receipt of the detection signal; and wherein the magnetic sensing mechanism is affixed, attached, or mechanically coupled to railyard equipment comprising at least one of a rail tie, a safety indicator, or a safety indicator receptacle.

14. The wireless magnetic sensing device of claim 13 further comprising a computer-readable memory associated with the processing mechanism, wherein the memory is capable of storing a magnetic sensing device identifier that uniquely identifies the wireless magnetic sensing device, and wherein the processing mechanism is programmed to activate the radio frequency transmitter to transmit the magnetic sensing device identifier with the data signal.

15. The wireless magnetic sensing device of claim 14 wherein the processing mechanism is programmed to repeatedly, periodically, or continuously activate the radio frequency transmitter to transmit the magnetic sensing device identifier and the data signal.

16. The wireless magnetic sensing device of claim 14 further comprising a receiver capable of receiving a radio frequency transmission from a remotely situated transmitter, wherein the processing mechanism is programmed to cause the radio frequency transmitter of the magnetic sensing device to repeat transmission of the magnetic sensing device identifier and the data signal until the receiver receives a signal from the remotely situated transmitter.

17. The wireless magnetic sensing device of claim 14 for use with a plurality of receivers capable of receiving a transmission from the radio frequency transmitter, wherein the radio frequency transmitter is capable of transmitting a wideband, phase-modulated, m-sequence radio frequency signal that includes the magnetic sensing device identifier and the data signal.

18. The wireless magnetic sensing device of claim 17 wherein the plurality of receivers are each capable of determining a defined epoch of a received wideband, phase-modulated, m-sequence radio frequency signal received from the radio frequency transmitter.

19. The wireless magnetic sensing device of claim 18 wherein a plurality of defined epoch determinations are combined to yield a location estimate for the wireless magnetic sensing device using a time difference of arrival (TDOA) technique.

20. The wireless magnetic sensing device of claim 14 further comprising a receiver capable of receiving a radio frequency transmission from a remotely situated transmitter, wherein the processing mechanism is programmed to cause the radio frequency transmitter of the magnetic sensing device to transmit the magnetic sensing device identifier and the data signal upon the receiver receiving a signal from the remotely situated transmitter.

21. The wireless magnetic sensing device of claim 20 wherein the magnetic sensing mechanism comprises a plurality of magnetic reed switches, hall effect devices, or other magnetic field sensors arranged in a fixed, predetermined pattern or array.

22. A wireless magnetic sensing system for monitoring railyard equipment status, the system comprising:

a wireless magnetic sensing device including: (i) a magnetic sensing mechanism for sensing an applied magnetic field, and for generating a detection signal upon sensing of the applied magnetic field; (ii) a processing mechanism, operatively coupled to the magnetic sensing mechanism, for receiving the detection signal; and (iii) a radio frequency transmitter, responsive to the processing mechanism, for transmitting a data signal indicative of said sensing of the applied magnetic field; wherein the processing mechanism is programmed to activate the radio frequency transmitter upon receipt of the detection signal;

a safety indicator affixed, attached, or mechanically coupled to the wireless magnetic sensing device; and a safety indicator receptacle, for receiving the safety indicator, and configured to have at least one permanent magnet in proximity thereto; wherein, when the safety indicator is inserted into the safety indicator receptacle, a magnetic field created by the permanent magnet across the receptacle is detected by the magnetic sensing mechanism of the magnetic sensing device.

23. The wireless magnetic sensing system of claim 22 wherein a plurality of permanent magnets are placed in proximity to the receptacle in a predetermined array or arrangement.

24. A wireless magnetic sensing system for monitoring railyard equipment status, the system comprising:

a wireless magnetic sensing device including: (i) a magnetic sensing mechanism for sensing an applied magnetic field, and for generating a detection signal upon sensing of the applied magnetic field; (ii) a processing mechanism, operatively coupled to the magnetic sensing mechanism, for receiving the detection signal; and (iii) a radio frequency transmitter, responsive to the processing mechanism, for transmitting a data signal indicative of said sensing of the applied magnetic field; wherein the processing mechanism is programmed to activate the radio frequency transmitter upon receipt of the detection signal;

a safety indicator having one or more permanent magnets affixed, attached, or mechanically coupled thereto; and a safety indicator receptacle in proximity to the wireless magnetic sensing device for receiving the safety indicator;

wherein, when the safety indicator is inserted into the safety indicator receptacle, a magnetic field created by the one or more permanent magnets is detected by the magnetic sensing mechanism of the magnetic sensing device.

25. The wireless magnetic sensing system of claim 24 wherein a plurality of permanent magnets are affixed, attached, or mechanically coupled to the safety indicator in a predetermined array or arrangement.

* * * * *